US005080347A

United States Patent [19]

Funada

[11] Patent Number: 5,080,347

[45] Date of Patent: Jan. 14, 1992

[54] SHEET PAPER FEEDER

[75] Inventor: Hitoshi Funada, Chiba, Japan

[73] Assignee: Komori Corporation, Tokyo, Japan

[21] Appl. No.: 528,737

[22] Filed: May 24, 1990

[30] Foreign Application Priority Data

Jun. 23, 1989 [JP] Japan ..... 1-159400

[51] Int. Cl.[5] ..... B65H 5/12

[52] U.S. Cl. ..... 271/266; 271/227; 271/246; 271/247; 271/265; 271/274; 74/820

[58] Field of Search ..... 271/114, 115, 116, 227, 271/245, 246, 247, 255, 265, 273, 274, 266; 74/122, 820

[56] References Cited

U.S. PATENT DOCUMENTS 2,984,482 5/1961 Kist et al. ..... 271/246 X
4,021,030 5/1977 Fichte et al. ..... 271/11
4,416,165 11/1983 Kramer et al. ..... 74/70

FOREIGN PATENT DOCUMENTS 1496097 7/1975 United Kingdom ..... 74/820

*Primary Examiner*—H. Grant Skaggs
*Assistant Examiner*—Carol Lynn Druzbick
*Attorney, Agent, or Firm*—Abelman Frayne & Schwab

[57] ABSTRACT

A sheet paper feeder for use in a printing press, includes a cam mechanism interposed between sheet feeding rollers, and a source of drive force for the sheet feeding rollers which are adapted to be repeatedly rotated and stopped along a programmed continuous cam operation curve. A retracting mechanism associated with sheet holddown wheels operates in synchronism with the sheet feeding rollers to cause reciprocating movement of the sheet holddown wheels toward and away from the sheet feeding rollers. An accurately registered sheet is held between the sheet feeding rollers and the sheet holddown wheels while the sheet feeding rollers are stationary, and the sheet feeding rollers are then accelerated up to a predetermined peripheral speed so that, even if the sheet has a slippery surface, or, the sheet feed rate exceeds 100 sheets per minute, the sheet can be accurately and reliably fed in synchronism with the operation of the printing press without causing any slip between the sheet feeding rollers and the sheet.

1 Claim, 6 Drawing Sheets

SHEET PAPER FEEDER

BACKGROUND OF THE INVENTION

This invention relates to a sheet paper feeder of the type in which a flat paper or, sheet such as printing paper or an interleaved paper, is held between sheet feeding rollers and sheet holddown wheels, and is then fed toward a sheet feeding cylinder or a sheet delivery apparatus.

In a sheet-feed offset printing press, a sheet paper feeder is provided so that, after printing papers successively fed from an automatic sheet feeder are temporarily stopped by the combination of front register lays and side register lays regulating the register of the printing papers, the printing papers are accelerated up to a speed equal to the peripheral speed of an impression cylinder and are then delivered with accurate timing toward a gripper of the impression cylinder.

Further, in the case of, for example, intaglio printing where printing papers are printed with an ink film having a relatively large film thickness, stacking of the printing papers in tiers on a pile board tends to give rise to an undesirable offset.

In order to avoid such an undesirable offset, a method is commonly employed in which an interleaving paper is interposed between the printing papers to be vertically stacked in tiers on the pile board. In this case, it is necessary to feed the interleaving papers with accurate timing toward a gripper of a sheet delivery apparatus so as to interpose the interleaving paper between the printing papers vertically stacked in tiers on the pile board. In this case too, a sheet paper feeder of the kind described above is used.

As one form of such a sheet paper feeder, a feed-roll type is known in which a sheet, such as printing paper or interleaved paper, is held between rotating sheet feeding rollers and holddown wheels disposed opposite to the feeding rollers and is fed under acceleration toward a feeding cylinder or a sheet delivery apparatus.

In a prior art sheet paper feeder of the feed-roll type, the sheet feeding rollers are continuously driven to rotate at a peripheral speed corresponding generally to the peripheral speed of an impression cylinder, or that of delivery chains of a sheet delivery apparatus. The sheet holddown wheels disposed opposite to the sheet feeding rollers are reciprocated toward and away from the sheet feeding rollers. As soon as the holddown wheels are moved toward the sheet feeding rollers, and a sheet is held between the sheet feeding rollers and the sheet holddown wheels, the sheet is fed toward the impression cylinder or the delivery chains of the sheet delivery apparatus.

However, in the prior art sheet paper feeder having the sheet feeding rollers and the sheet holddown wheels described above, slip tends to occur between a sheet and the sheet feeding rollers when the sheet feed rate exceeds 100 sheets per minute or when the sheet is, for example, a coated sheet having a slippery surface.

Thus, the prior art sheet paper feeder has the disadvantages that the occurrence of slip between the sheet and the sheet feeding rollers leads to delayed timing of sheet feeding, with the result that a wasted paper is delivered due to deviation of the sheet from its predetermined printing position, or, failure of proper gripping of the sheet by the gripper gives rise to undesirable stoppage of the operation of the printing press.

As described above, in the prior art sheet paper feeder, a printing paper or an interleaving paper is temporarily maintained in a stationary state after it is registered and is then instantaneously accelerated up to the speed equal to the peripheral speed of the impression cylinder or the delivery chains of the sheet delivery apparatus in the printing press.

OBJECT OF THE INVENTION

It is an object of the present invention to provide a sheet paper feeder for use in a printing press, which eliminates the possibility of undesirable slip between a sheet and sheet feeding rollers even when the sheet has a slippery surface, or, when the sheet feed rate exceeds 100 sheets per minute, so that the sheet can be reliably fed in synchronism with the operation of the printing press.

SUMMARY OF THE INVENTION

The present invention provides a sheet paper feeder comprising rotatable sheet feeding rollers, rotatable sheet holddown wheels disposed opposite to the sheet feeding rollers respectively for feeding a registered sheet while holding the registered sheet between the sheet feeding rollers and the sheet holddown wheels, the sheet feeding rollers being operatively connected to a source of drive force through a cam mechanism including cam means adapted to be repeatedly rotated and stopped according to a programmed continuous cam operation curve, and said sheet holddown wheels being associated with retracting means for causing reciprocating movement of the sheet holddown wheels toward and away from the sheet feeding rollers in synchronous relation with the operation of the sheet feeding rollers.

Therefore, after the sheet is registered, the retracting means acts to advance the sheet holddown wheels toward the sheet feeding rollers until the sheet is firmly held between the sheet holddown wheels and the sheet feeding rollers. Then, by the function of the cam mechanism, the sheet feeding rollers kept in their stationary state start to rotate and are accelerated so as to deliver the sheet accelerated up to a predetermined speed.

No slip occurs between the sheet feeding rollers and the sheet because the sheet feeding rollers are continuously accelerated from their stationary state up to a predetermined peripheral speed according to the programmed cam operation curve.

DETAILED DESCRIPTION OF THE PREFERRED EMBODIMENT

Figure 6:
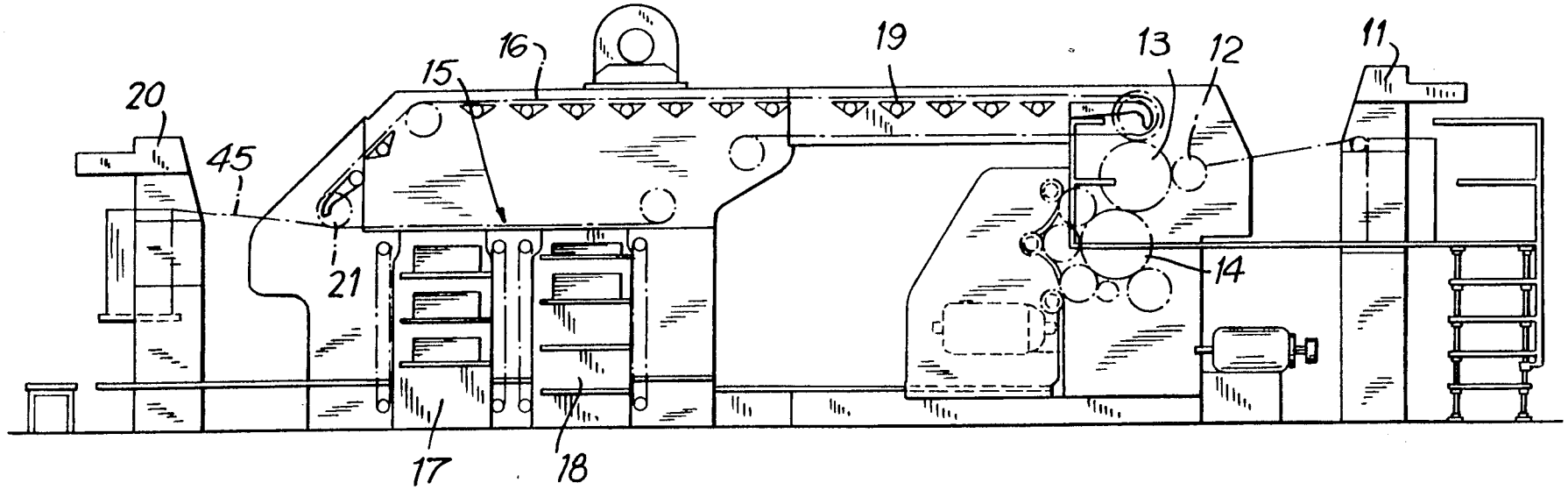
FIG. 6 is a diagrammatic general view of one form of an intaglio printing press.

FIG. 6 is a diagrammatic general view of one form of an intaglio printing press which is equipped with an embodiment of the sheet paper feeder of the present invention applied for feeding interleaving papers.

Referring to FIG. 6, a printing paper is fed from a printing paper feeder 11 toward a sheet feeding cylinder 12 and passes then between an impression cylinder 13 and a plate cylinder 14 to be printed. The printed printing paper is delivered by delivery chains 16 of a sheet delivery apparatus 15 toward one of a pair of pile boards 17 and 18. Air jets 19 are incorporated in the sheet delivery apparatus 15 so that the ink on the printing paper may not contact and contaminate a paper guide and other parts (not shown). On the other hand, an interleaving paper is fed from an interleaving paper feeder 20 at a speed synchronous with the conveying speed of the printing paper and is superposed, in the vicinity of sheet joining sprockets 21 in the sheet delivery apparatus 15, on the printing paper held on the delivery chains 16 engaging the sprockets 21. The superposed combination of the printing paper and the interleaving paper is stacked on one of the pair of the pile boards 17 and 18.

Figure 1:
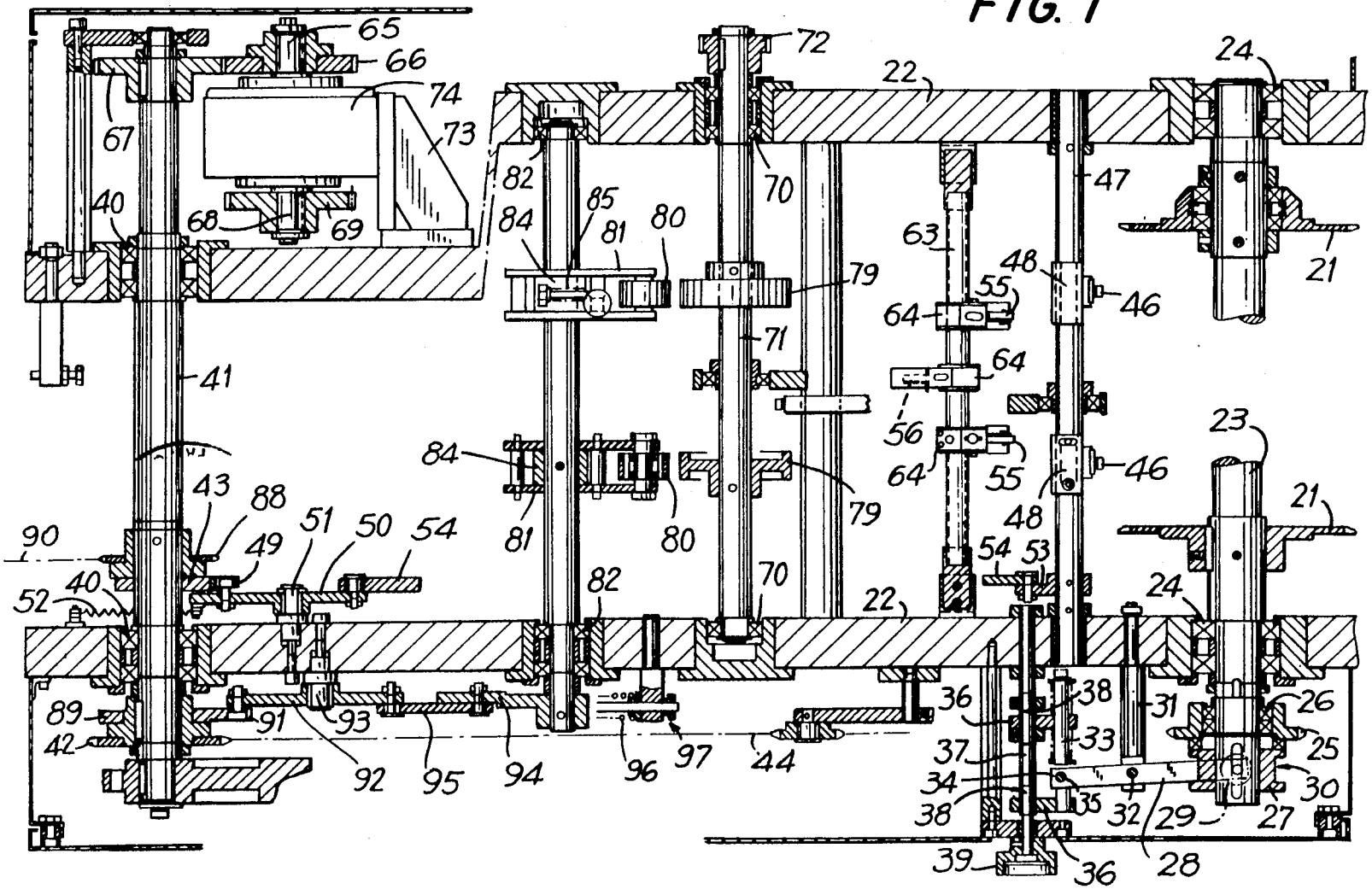
FIG. 1 is a developed, partial sectional view of an embodiment showing application of the present invention to a sheet paper feeder feeding interleaving papers.
Figure 2:
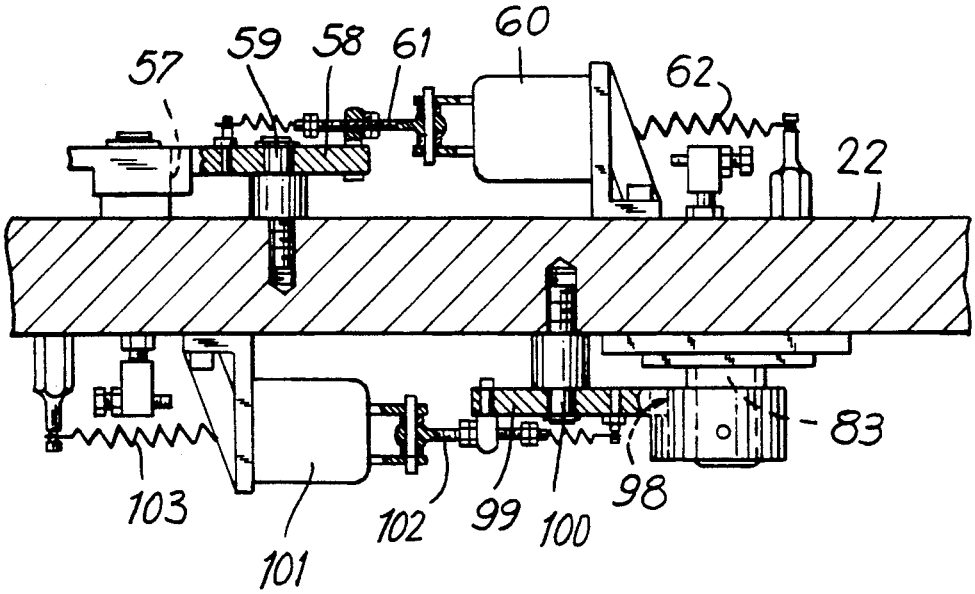
FIG. 2 is a developed, enlarged sectional view of a safety mechanism associated with the front register lays and sheet holddown wheels in the embodiment shown in FIG. 1.
Figure 3:
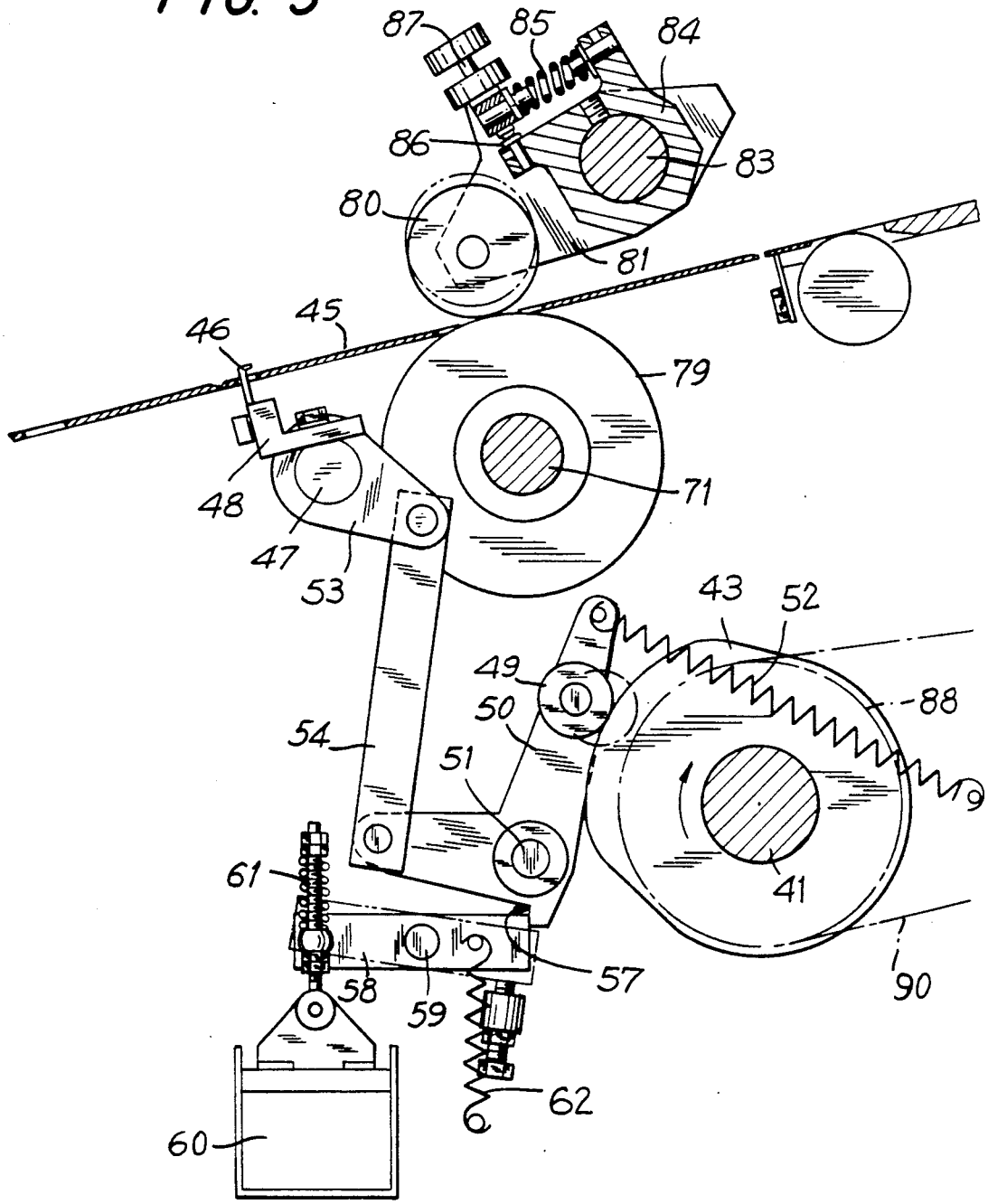
FIG. 3 diagrammatically shows a drive mechanism used for driving the front register lays in the embodiment shown in FIG. 1.

FIG. 1 is a developed, partial sectional view of the sheet paper feeder embodying the present invention, FIG. 2 is a developed, enlarged sectional view of a safety mechanism associated with front register lays and sheet holddown wheels in the sheet paper feeder shown in FIG. 1, and FIG. 3 diagrammatically shows a drive mechanism used for driving the front register lays in the sheet paper feeder shown in FIG. 1.

Referring to FIGS. 1, 2 and 3, a sprocket shaft 23 mounting the sheet joining sprockets 21 in the sheet delivery apparatus 15 shown in FIG. 6 extends between a pair of frames 22 and is journalled in bearings 24 at its both ends respectively so that the sprocket shaft 23 is freely rotatably supported between the frames 22. A drive sprocket 25 is freely rotatably mounted through a bearing 26 on an extension of one end of the sprocket shaft 23. Further, a clutch sleeve 27 is mounted through a key (not shown) on the extension of one end of the sprocket shaft 23 so that the drive sprocket 25 can be rotated in unitary relation with the sprocket shaft 23.

Therefore, when the delivery chains 16 in the sheet delivery apparatus 15 shown in FIG. 6 are actuated, one of the sheet jointing sprockets 21 engaged by the respective delivery chains 16, that is, the sprocket 21 integrally fixed to the sprocket shaft 23 acts to rotate the sprocket shaft 23.

The clutch sleeve 27 is formed at its outer periphery with a guide groove 30 in which a guide roller 29 freely rotably mounted on one end of a swing lever 28 is received so as to make free rolling contact with the guide groove 30. The swing lever 28 is freely swingably pivoted at its middle portion by a pivot pin 32 to a stay 31 erected on one of the frames 22. Also, this swing lever 28 is formed at the other end with an elongate slot 35 engaged by a pin 34 fixed to a slide bar 33 disposed in parallel to the stay 31. A pair of spaced nut blocks 36 are integrally fixed to the slide bar 33. A handle shaft 37 freely rotatably extends at one end into one of the frames 22 and has a pair of male or externally screw threaded portions 38 making screw threaded engagement with the nut blocks 36 respectively. A clutch actuating knob 39 is mounted on the other end of the handle shaft 37.

Therefore, when the clutch actuating knob 39 is manipulated to rotate the handle shaft 37, the slide bar 33 makes its vertical movement in FIG. 1. As a result, the clutch sleeve 27 is shifted along the sprocket shaft 23 by being guided by the guide roller 29 of the swing lever 28 thereby permitting or inhibiting transmission of drive force from the sprocket shaft 23 to the drive sprocket 25.

A drive shaft 41 extending in parallel to the sprocket shaft 23 is freely rotatably received at its both end portions in the frame pair 22 through respective bearings 40. A follower sprocket 42 and a disk cam 43 which is associated with front register lays described later are integrally mounted at spaced positions on one of the end portions of the drive shaft 41. An endless drive chain 44 is wound to engage both the follower sprocket 42 and the drive sprocket 25, so that, when the drive sprocket 25 is coupled to the sprocket shaft 23 by the clutch sleeve 27, the drive shaft 41 is rotated by the drive chain 44 in synchronous relation with the rotation of the sprocket shaft 23.

A feed board 45 extends in inclined relation from the interleaving paper feeder 20 shown in FIG. 6 toward the sheet joining sprockets 21. A pair of front register lays 46 which can protrude upward beyond the feed board 45 are fixed through respective brackets 48 to a front register-lay supporting shaft 47 which extends in parallel to the sprocket shaft 23 and which is freely rotatably supported at both ends in the respective frames 22. A cam roller 49 making rolling contact with the outer periphery of the disc cam 43 is freely rotatably supported on one end of a bellcrank 50 which is freely rockably supported by a supporting pin 51 on one of the frames 22. A tension coil spring 52 is connected between one end of the bellcrank 50 and one of the frames 22 so as to normally urge the cam roller 49 into rolling contact with the outer peripheral surface of the disc cam 43. The bellcrank 50 is connected at the other end by a link 54 to one end of a front register-lay actuating lever 53 integrally fitted on the front register-lay supporting shaft 47.

Therefore, when the drive shaft 41 is rotated clockwise from the state shown in FIG. 3, the bellcrank 50 makes clockwise rocking movement around the supporting pivot pin 51 to cause counter-clockwise rotation of the front register-lay supporting shaft 47 through the link 54 and the actuating lever 53. As a result, the front register lays 46 are retracted to a position beneath the feed board 45. This retracting operation is repeated whenever the drive shaft 41 makes one complete rotation.

In the illustrated embodiment of the present invention, a pair of spaced sheet sensors 55 and an intermediate sheet sensor 56 are provided so as to detect whether or not an interleaving paper (not shown) is accurately registered. A safety mechanism is also provided so that the front register lays 46 may not be retracted when the sheet sensors 55 and 56 detect that the interleaving paper is not accurately registered.

The safety mechanism includes a locking lever 58 engageable at one end with an engaging portion 57 formed on the bellcrank 50. This locking lever 58 is rockably pivoted at its middle portion by a supporting pivot pin 59 to one of the frames 22. This locking lever 58 is connected at the other end by a pin to a solenoid 60 through a connecting rod 61 connecting the locking lever 58 to the solenoid 60 mounted on one of the frames 22. A tension coil spring 62 is connected between one end of the locking lever 58 and one of the frames 22 so that the locking lever 58 is normally urged away from the engaging portion of the bellcrank 50.

The sheet sensors 55 and 56 are mounted through respective brackets 64 on a cross beam 63 extending between the frames 22. The spaced sheet sensors 55 act to detect any inclination of the interleaving paper, while the intermediate sheet sensor 56 acts to detect the presence or absence of the interleaving paper.

Therefore, when the sheet sensors 55 detect an inclination or the absence of the interleaving paper, the solenoid 60 is energized to urge the connecting rod 61 downwardly in FIG. 3 against the biasing force of the tension coil spring 62. As a result, the locking lever 58 normally maintained in the state shown by the two-dot chain line in FIG. 3 is urged to make counter-clockwise rocking movement around the pivot pin 59 and engages at one end with the engaging portion 57 of the bellcrank 50 thereby inhibiting the rocking movement of the bellcrank 50. Thus, the interleaving paper cannot flow on the feed board 45 toward the sheet joining sprockets 21.

Figure 4:
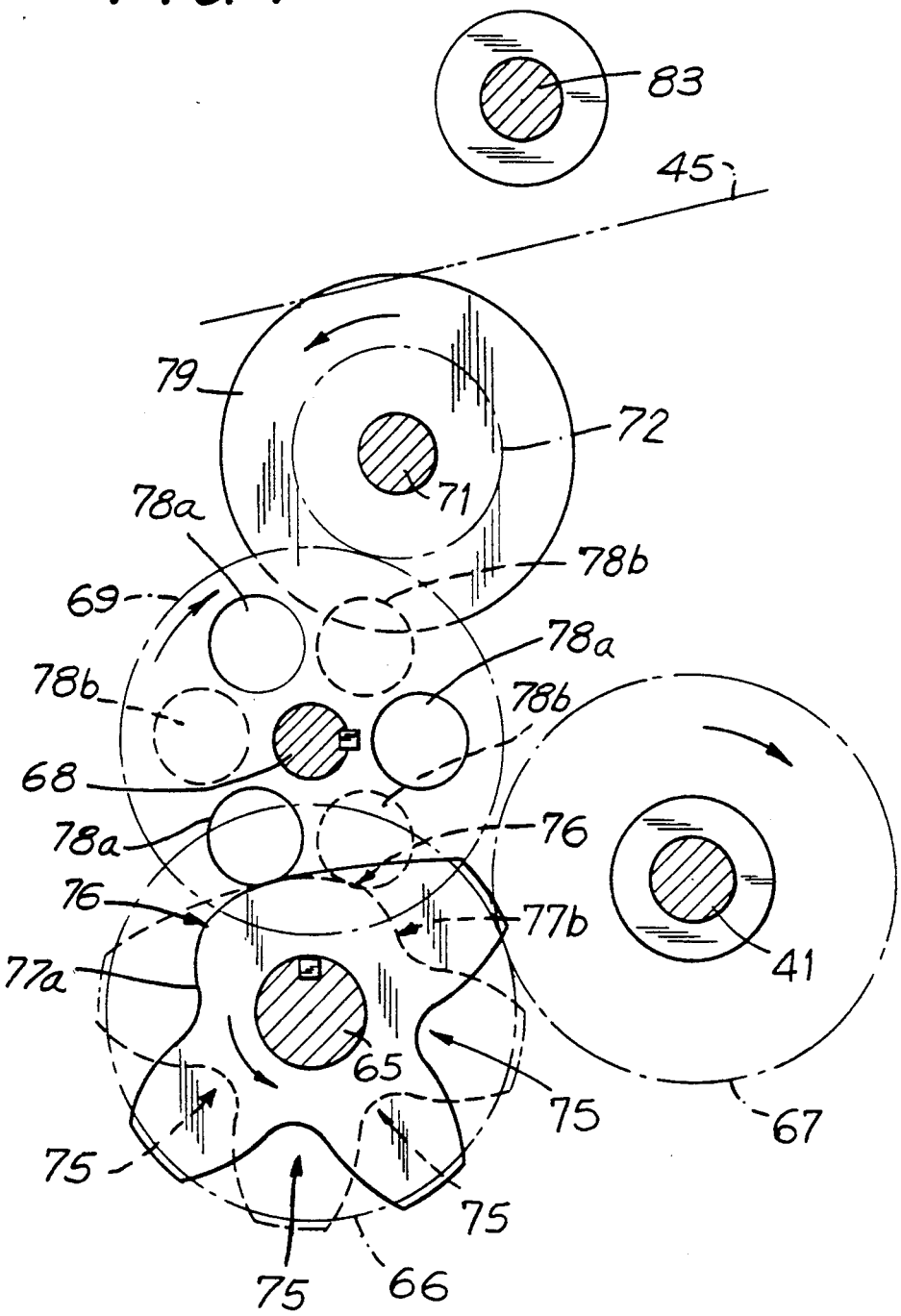
FIG. 4 diagrammatically shows a cam mechanism employed in the embodiment shown in FIG. 1.

FIG. 4 diagrammatically shows the structure of a cam mechanism operatively connected to a pair of spaced sheet feeding rollers 79. Referring to FIGS. 1 and 4, a drive gear 67 is integrally fixed on the other end of the drive shaft 41 so as to make meshing engagement with an input gear 66 mounted on a cam input shaft 65. A shaft 71 carrying the sheet feeding rollers 79 is freely rotatably received at both ends in the pair of the frames 22 through bearings 70 respectively and extends in parallel to the sprocket shaft 23. A follower to gear 72 integrally fixed on one end of the roller shaft 71 makes meshing engagement with an output gear 69 integrally fixed on a cam output shaft 68.

The cam input shaft 65 and the cam output shaft 68 are freely rotatably mounted on a cam casing 74 fixed to the other frame 22 by a bracket 73. A so-called parallel cam mechanism is employed in the illustrated embodiment of the present invention. More precisely, two plate cams 77*a* and 77*b* each having a plurality of gear groove portions 75 and an arcuate lobe portion 76 are fitted on the cam input shaft 65 in a line symmetrical parallel relation and with different phases and two sets of follower rollers 78*a* and 78*b* corresponding to the plate cams 77*a* and 77*b* respectively are integrally assembled around the cam output shaft 68 in a relation equally circumferentially spaced apart from each after and with different phases. The total number of these follower rollers 78*a* and 78*b* is even, and the rollers 78*a* and 78*b* are arranged to engage the portions 75 and 76 of the plate cams 77*a* and 77*b* respectively.

For details of this parallel cam mechanism, reference is to be made to a book entitled "Study on Mechanisms of Automatic Machines" written by Hiroshi Makino and published by Nikkan Kogyo Shinbunsha (Daily Industrial News) Ltd. on June 1, 1976.

Therefore, when the follower rollers 78*a* and 78*b* make rolling engagement with the arcuate lobe portions 76 of the plate cams 77*a* and 77*b*, rotation of the cam input shaft 65 is not transmitted to the cam output shaft 68, and the cam output shaft 68 remains in its stationary state. However, when the cam input shaft 65 rotates counter-clockwise from the state shown in FIG. 4, the arcuate lobe portion 76 of the plate cam 77*a* urges the corresponding follower roller 78 in the clockwise direction around the cam output shaft 68, and, as a result, the cam output shaft 68 starts to rotate in the clockwise direction from its stationary state and is gradually accelerated. Then, when the follower rollers 78*a* and 78*b* engage successively the gear groove portions 75 of the plate cams 77*a* and 77*b* respectively, the rotation of the cam input shaft 65 is transmitted to the cam output shaft 68 in a manner similar to meshing engagement between gears. After the cam output shaft 68 rotates at its rated speed to rotate the sheet feeding roller shaft 71 at the rated speed, the cam output shaft 68 is decelerated until it is restored to its original stationary state.

Figure 5:
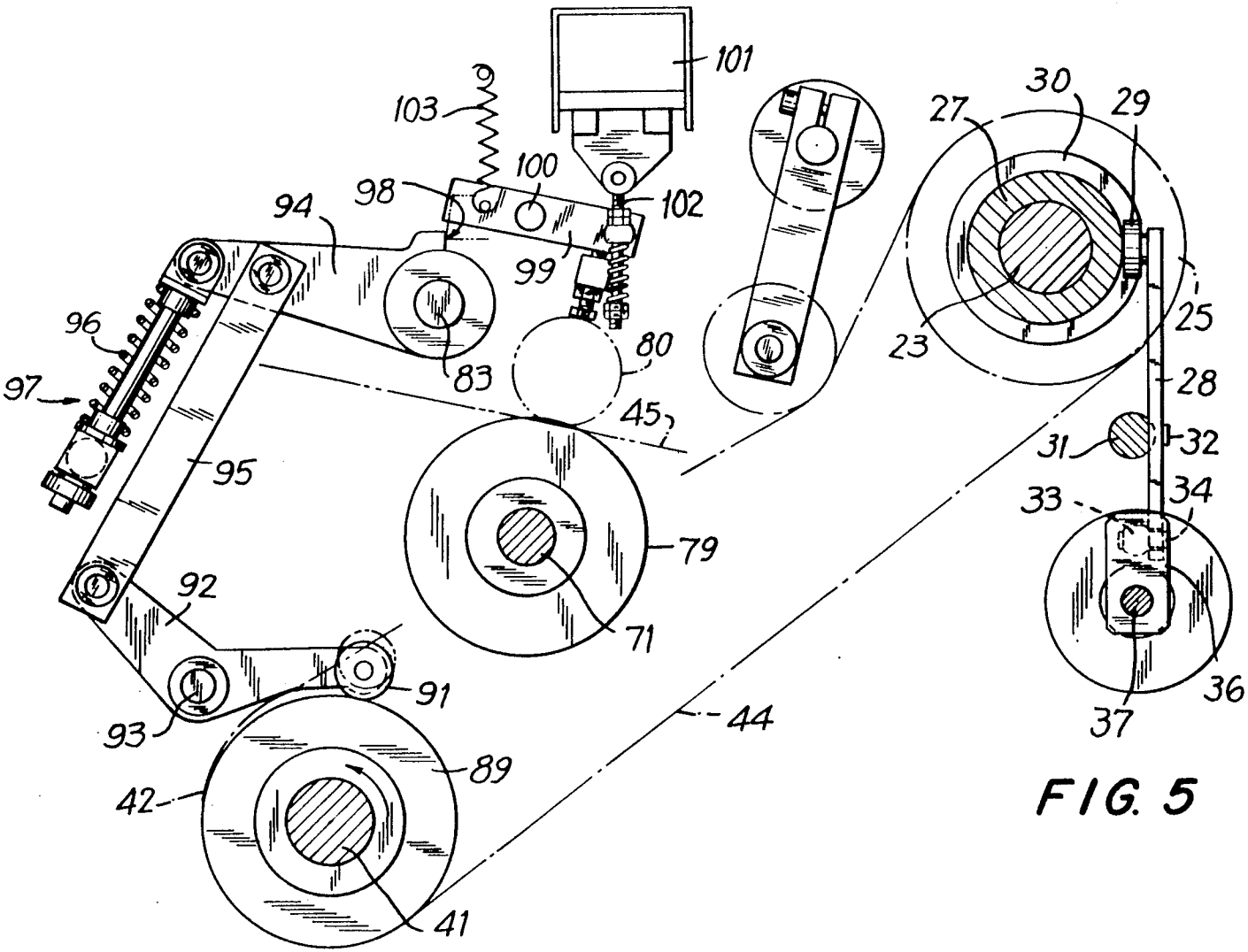
FIG. 5 diagrammatically shows a drive mechanism used for retracting the sheet holddown wheels in the embodiment shown in FIG. 1.

FIG. 5 diagrammatically shows a drive mechanism for causing retracting movement of sheet holddown wheels 80. Referring to FIGS. 1, 3 and 5, the sheet feeding roller shaft 71 has the pair of integrally mounted sheet feeding rollers 79. These sheet feeding rollers 79 have their outer peripheral surfaces locally slightly protruding beyond the surface of the feed board 45. Each of a pair of spaced wheel holders 81 freely rotatably supports the sheet holddown wheel 80 located opposite to the corresponding sheet feeding roller 79, so that these sheet holddown wheels 80 cooperate with the associated sheet feeding rollers 79 to hold an interleaving paper. The wheel holders 81 are supported on a wheel shaft 83 so as to be rotatable relative to the wheel shaft 83. The wheel shaft 83 is freely rotatably supported at both ends in the frames 22 through respective bearings 82 and extends in parallel to the sprocket shaft 23. A pair of spaced holder receivers 84 are integrally fitted on the wheel shaft 83, and a compression coil spring 85 normally biasing each of the sheet holddown wheels 80 toward the corresponding sheet feeding roller 79 is interposed between each of the holder receivers 84 and the corresponding wheel holder 81. A pressure adjusting screw-threaded rod 87 is mounted on each of the wheel holders 81 and is adapted to contact at one end with a stopper portion formed on the holder receiver 84 so as to adjust the pressure applied from the sheet holddown wheel 80 to the associated sheet feeding roller 79.

On the other hand, a power transmitting sprocket 88 is integrally mounted on the drive shaft 41 at a position adjacent to the disc cam 43, and a disc cam 89 for causing retracting movement of the front register lays 46 is also integrally mounted on the drive shaft 41 at a position adjacent to the follower sprocket 42. An endless chain 90 engages the power transmitting sprocket 88 so as to transmit the drive force from the drive shaft 41 to the interleaving paper feeder 20 shown in FIG. 6. A cam roller 91 making rolling engagement with the outer peripheral surface of the disc cam 89 is freely rotatably supported on one end of a bellcrank 92. This bellcrank 92 is rockably supported by a supporting pivot pin 93 on one of the frames 22. The bellcrank 92 is connected at the other end by a link 95 to one end of a swing lever 94 integrally fitted on the wheel shaft 83. A biasing means 97 including a compression coil spring 96 is interposed between the said end of the swing lever 94 and one of the frames 22 so as to normally urge the swing lever 94 clockwise in FIG. 5 thereby normally biasing the cam roller 91 into rolling engagement with the outer peripheral surface of the disc cam 89.

Therefore, when the drive shaft 41 rotates counter-clockwise from the state shown in FIG. 5, the bellcrank 92 makes counter-clockwise rocking movement around the pivot pin 93 to cause counter-clockwise rotation of the wheel shaft 83 through the link 95 and the swing lever 94. As a result, each of the sheet holddown wheels 80 is retracted away from the associated sheet feeding roller 79 by being urged from the position shown by the solid line in FIG. 3 to the position shown by the two-dot chain line. This retracting operation is repeated while the drive shaft 41 makes one complete rotation. Thus, as described already, the interleaving paper registered in interlocking relation with the operation of the front register lays 46 is held between the sheet feeding rollers 79 and the sheet holddown wheels 80 to be delivered toward the delivery chains 16 in the sheet delivery apparatus 15 shown in FIG. 6.

In the illustrated embodiment, a safety mechanism is provided so that, when the aforementioned sheet sensors 55 and 56 detect that the interleaving paper is not accurately registered, the interleaving paper may not be fed toward the sheet delivery apparatus 15. The safety mechanism includes a locking lever 99 which is engageable at one end with an engaging portion 98 formed on the swing lever 94. This locking lever 99 is pivoted at its middle portion to one of the frames 22 by a supporting pivot pin 100 and is connected by a connecting rod 102 to a solenoid 101 fixed to the frame 22. Further, a tension coil spring 103 is interposed between the one end of the locking lever 99 and the frame 22 so as to normally bias that end of the locking lever 99 away from the engaging portion 98 of the swing lever 94.

Therefore, when the sheet sensors 55 and 56 detect that the interleaving paper is not accurately registered, the solenoid 101 is energized to cause vertical upward movement of the connecting rod 102 in FIG. 5 against the biasing force of the tension coil spring 103. As a result, the locking lever 99 is rocked counter-clockwise from the position shown by the solid line in FIG. 5 around the pivot pin 100 until its one end engages with the engaging portion 98 of the swing lever 94 thereby inhibiting further swinging movement of the swing lever 94. Thus, the safety mechanism eliminates the possibility that the interleaving paper on the sheet feeding rollers 79 is strongly forced onto the sheet feed rollers 79 by the sheet holddown wheels 80 and is fed on the feed board 45 toward the downstream side.

The interleaving paper is fed along the feed board 45 from the sheet feeder 20 in synchronous relation with the operation of the sheet delivery apparatus 15. At this time, the sheet holddown wheels 80 are in their retracted position, and, when the leading end of the interleaving paper is abutted by the front register lays 46, the movement of the interleaving paper is stopped. Then, when the sheet sensors 55 and 56 detect that the interleaving paper is accurately registered, the sheet holddown wheels 80 are advanced toward the sheet feeding rollers 79 by the function of the retracting disc cam 89 to hold the interleaving paper between them and the sheet feeding rollers 79. Under the above condition, the sheet feeding rollers 79 are still held in the stationary state because the follower rollers 78*a* and 78*b* are now in contact with the arcuate lobe portions 76 of the plate cams 77*a* and 77*b* respectively. Also, after the advancing movement of the sheet holddown wheels 80, the front register lays 46 are retracted by the function of the front register-lay actuating disc cam 43 to the position beneath the feed board 45. Then, when the follower rollers 78*a* and 78*b* engage now with the gear groove portions 75 of the plate cams 77*a* and 77*b* respectively, the cam output shaft 68, hence, the sheet feeding rollers 79 are accelerated so as to feed the interleaving paper toward the delivery chains 16 in the sheet delivery apparatus 15. At this time, the peripheral speed of the accelerated sheet feeding rollers 79 becomes as high as about the moving speed of the delivery chains 16. Therefore, even when the interleaving papers are successively fed at a high speed which will exceed a feed rate of 100 sheets per minute, no slip occurs between the interleaving papers and the sheet feeding rollers 79, so that the interleaving papers can be accurately and reliably fed toward the sheet delivery apparatus 15.

In the state in which the follower rollers 78*a* and 78*b* engage the gear groove portions 75 of the respective plate cams 77*a* and 77*b*, the peripheral speed of the sheet feeding rollers 79 is selected to be substantially equal to the moving speed of the delivery chains 16. Thus, the interleaving papers can be satisfactorily accurately overlapped on alternate printed papers held on the delivery chains 16, and the alternately overlapped printed and interleaving papers are stacked on one of the pipe boards 17 and 18.

While the illustrated embodiment has referred to an application of the present invention to an interleaving paper feeder by way of example, it is apparent that the present invention is equally effectively applicable to a sheet paper feeder feeding printing papers. Also, it is apparent that, by suitably changing the length of the arcuate lobe portion 76 of each of the plate cams 77*a* and 77*b*, the length of time during which the sheet feeding rollers 79 are held against rotation can be changed as desired. Further, it is apparent that, by suitably changing the cam profile in the area between the arcuate lobe portion 76 and the gear groove portions 75 in each of the plate cams 77*a* and 77*b*, the rate of acceleration and deceleration of the sheet feeding rollers 79 can be changed, as desired.

What is claimed is:

1. A sheet paper feeder comprising rotable sheet feeding rollers, rotable sheet holddown wheels disposed opposite to said sheet feeding rollers respectively for feeding a registered sheet while holding said registered sheet between said sheet feeding rollers and said sheet holddown wheels, said sheet feeding rollers being operatively connected to a source of drive force through a cam mechanism including cam means adapted to be repeatedly rotated and stopped according to a programmed cam operation curve, said sheet holddown wheels being associated with retracting means for causing reciprocating movement of said sheet holddown wheels toward and away from said sheet feeding rollers in synchronous relation with the operation of said sheet feeding rollers, wherein said cam mechanism includes a cam input shaft connected to a source of drive force, two plate cams each being formed with an arcuate lobe portion and a plurality of gear groove portions and being mounted on said cam input shaft in a line symmetrical parallel relation and with different phases, a cam output shaft disposed in parallel to said cam input shaft and operatively connected to said sheet feeding rollers, and two sets of follower rollers amounting to an even number in total and arranged to make rolling engagement with the arcuate lobe portions and the gear groove portions of said two plate cams respectively, said two sets of said follower rollers being integrally assembled around said cam output shaft in a relation equally spaced apart from each other and with different phases thereby constituting a parallel cam mechanism together with said plate cams.

* * * * *